US006397491B1

(12) United States Patent
Gilberti

(10) Patent No.: US 6,397,491 B1
(45) Date of Patent: Jun. 4, 2002

(54) ULTRAVIOLET LIGHT CURING APPARATUS

(76) Inventor: Joseph J. Gilberti, 45 Long View Rd., Avon, CT (US) 06001

( * ) Notice: Subject to any disclaimer, the term of this patent is extended or adjusted under 35 U.S.C. 154(b) by 0 days.

(21) Appl. No.: 09/691,993

(22) Filed: Oct. 19, 2000

(51) Int. Cl.[7] ..... F26B 3/34

(52) U.S. Cl. ..... 34/275; 34/266; 34/236; 118/642

(58) Field of Search ..... 34/275, 266, 184, 34/186, 236, 237, 238, 239, 105, 106, 107; 118/641, 642, 643

(56) References Cited

U.S. PATENT DOCUMENTS 3,935,647 A * 2/1976 Aschberger ..... 34/275
4,048,917 A * 9/1977 Skrypek et al. ..... 118/642
4,072,099 A * 2/1978 Martin ..... 34/275
4,193,204 A * 3/1980 Nerod ..... 34/275
4,233,754 A * 11/1980 Dubuit ..... 34/275
4,297,583 A * 10/1981 Nerod ..... 34/275
4,535,549 A * 8/1985 Lala et al. ..... 34/275
4,578,880 A * 4/1986 Motev et al. ..... 34/275
4,839,522 A * 6/1989 Bourgeois et al. ..... 34/275
4,882,853 A * 11/1989 Schaft ..... 34/275
5,411,588 A * 5/1995 Diepens et al. ..... 34/275
5,658,619 A * 8/1997 Kirschner et al. ..... 118/642
5,990,450 A * 11/1999 Kirker et al. ..... 118/642

* cited by examiner

*Primary Examiner*—Teresa Walberg
*Assistant Examiner*—Fadi H. Dahbour
(74) *Attorney, Agent, or Firm*—Alix, Yale & Ristas, LLP

(57) ABSTRACT

Apparatus for curing ink, paint and coatings on containers and articles which includes a rotatably mounted assembly that includes a plurality of workstations disposed about the periphery thereof, an emitter disposed next to the periphery of the rotatably mounted assembly, and apparatus sequentially positioning respective workstations in front of the emitter. In some forms of the invention the emitter is an ultraviolet radiation emitter and the apparatus for sequentially positioning includes apparatus for causing the workstations to dwell next to the emitter. Some forms of the invention include apparatus for selectively rotating at least some of the workstations when that workstation is in front of the emitter. Some forms of the invention include an apparatus for holding an associated work piece on at least some of the workstations.

8 Claims, 4 Drawing Sheets

ULTRAVIOLET LIGHT CURING APPARATUS

BACKGROUND OF THE INVENTION

The invention relates to apparatus for curing ink, paint and other coatings particularly on plastic, glass or metal bottles and jars or other containers as well as other articles. Ultraviolet curable inks are widely used to print product labels on products and the containers for products. While the invention has particular application to ultraviolet light curing by photopolymerization of ultraviolet light curable ink and other coatings it will be understood that some forms of the invention may be also applied to other applications. Similarly, while the invention has particular application to the curing of coatings on relatively small articles it will be understood that other forms of the invention may also be utilized on much larger articles.

The prior art includes apparatus such as the Ultraviolet Light Curing Apparatus described in U.S. Pat. No. 4,573,277 issued on Mar. 4, 1986 to Donald L. Sudduth. The apparatus described therein employs a rotating table apparatus having an entrance port area defined at one circumferential part. Guide members direct the article from the outer edge of the rotating table to the center of the table and back out to the outer part of the rotating table. The apparatus utilizes reflectors to achieve the desired cure. This mechanism with the reflectors and the mechanism for moving each article sequentially from the circumference of the rotating table to the center of the rotating table and then to the circumference of the rotating table is undesirably complex.

More particularly, the apparatus of Sudduth utilizes a rotary construction in which a plurality of workstations are disposed about the peripheral edge of a rotary table. As the rotary table moves about a vertical axis, each workstation passes sequentially to a loading position, a radiation position and an unloading position. The apparatus described therein suffers from substantial losses of ultraviolet energy. More specifically, these losses are caused by (1) energy from the ultraviolet light source not being focused, (2) the use of one or more reflectors and (3) by the use of mirrors. For example, the energy loss from a mirror is approximately 30 percent of the energy that is incident on that mirror. It is desirable to avoid such losses since they are prejudicial to achieving a uniform high quality cure.

SUMMARY OF THE INVENTION

It is an object of the present invention to provide apparatus having a relatively simple construction.

Another object of the invention is to provide apparatus that does not rely on the use of reflectors to achieve a proper cure of the coating on the work piece.

Still another object of the invention is to provide apparatus that has safety provisions to minimize the risk of injury to the operator of the apparatus.

Yet another object of the invention is to provide apparatus that will function with a wide variety of different work piece shapes, including rotationally symmetrical objects, oval objects and relatively flat objects, without the use of shutters or sensors for exposure control.

An additional object of the invention is to provide apparatus that facilitates rapid placement of work pieces within the apparatus and rapid removal of work pieces from the apparatus.

It has now been found that these and other objects of the invention may be attained in an apparatus for curing ink, paint and coatings on containers and articles which includes a rotatably mounted assembly that includes, in a preferred form, a plurality of workstations disposed about the periphery thereof and an emitter disposed next to the periphery of the rotatably mounted assembly and apparatus that sequentially positions respective workstations directly in front of the emitter.

In some forms of the invention the emitter is an ultraviolet radiation emitter and the apparatus for sequentially positioning includes apparatus for causing the workstations to dwell next to the emitter. The apparatus may further include apparatus for selectively rotating at least some of the workstations when a respective workstation is disposed next to the emitter and apparatus for holding an associated work piece on the workstations. Some forms of the apparatus for sequentially positioning include a mechanical mechanism which may be a Geneva mechanism. The apparatus for rotating each of the workstations may include a roller which may cooperate with a motor. Other forms of the invention include apparatus for changing the position at which any dwell occurs during the rotational cycle of the rotatably mounted assembly. Other forms of the invention includes apparatus for causing the dwell to occur simultaneously with at least two workstations being equally distant from the emitter.

BRIEF DESCRIPTION OF THE DRAWINGS

The invention will be better understood with reference to the accompanying drawings in which.

DESCRIPTION OF THE PREFERRED EMBODIMENT

Figure 1:
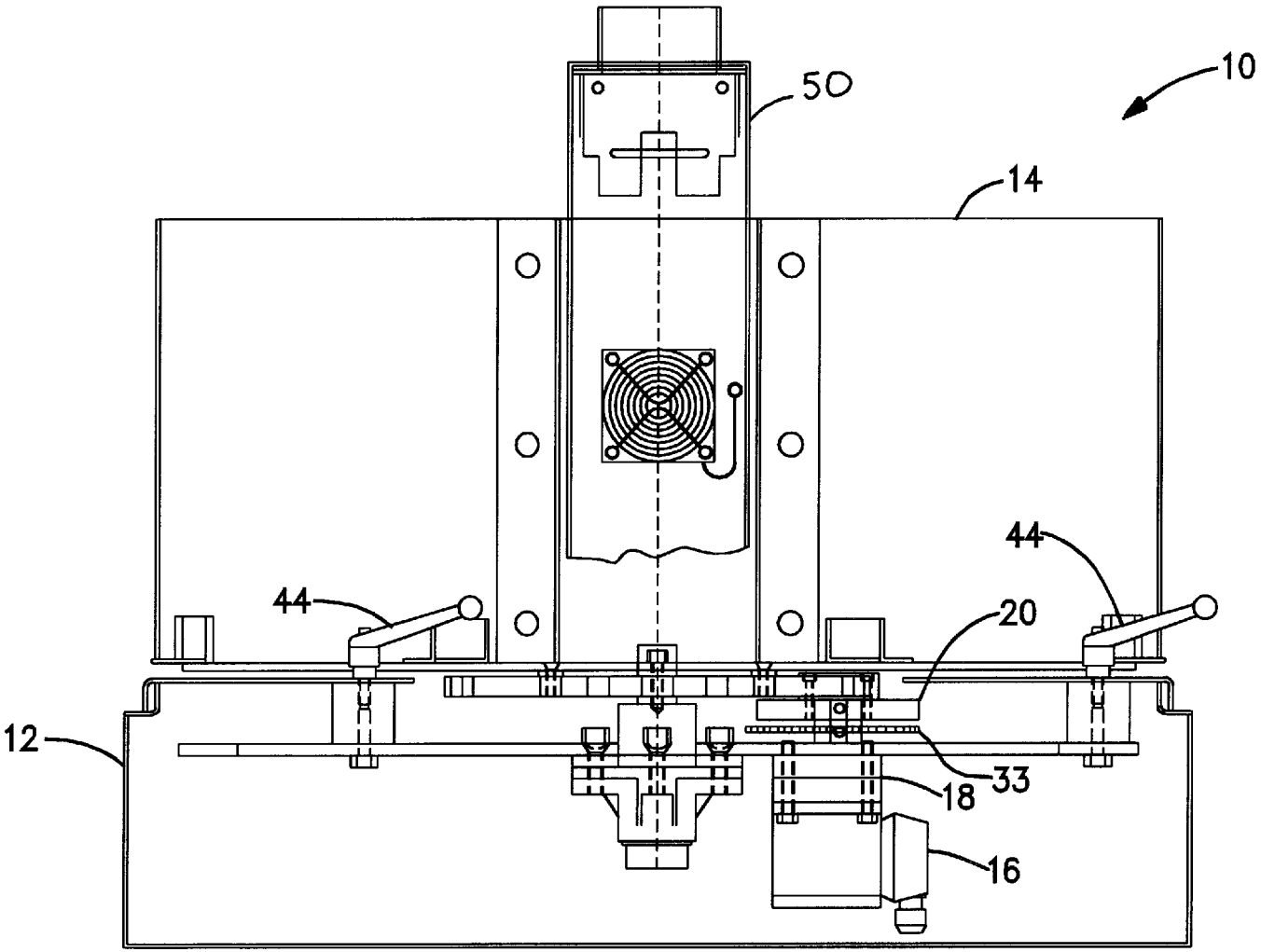
FIG. 1 is a rear elevation view of one form of the apparatus in accordance with the present invention.
Figure 2:
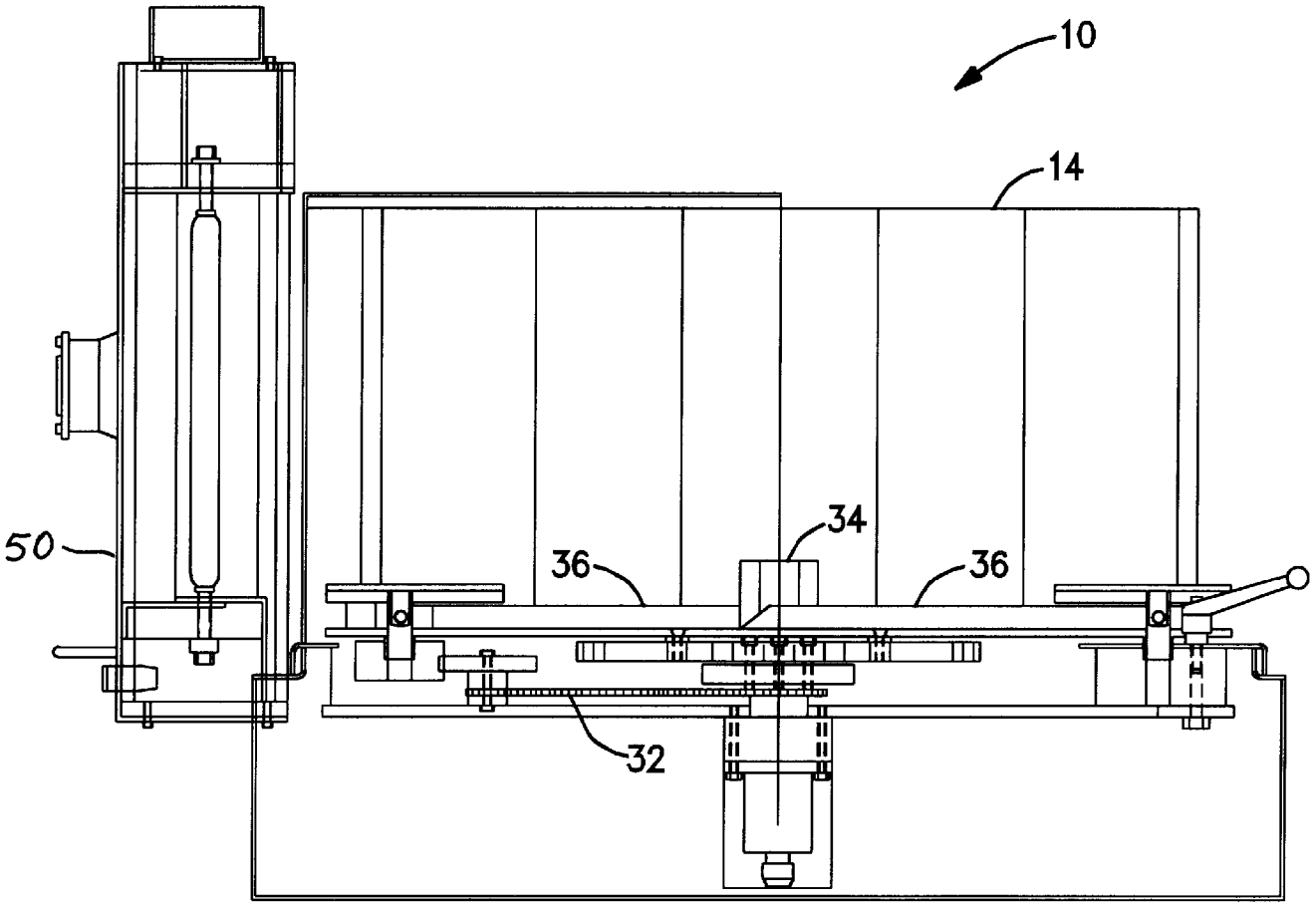
FIG. 2 is a side elevation view of the apparatus illustrated in FIG. 1.
Figure 3:
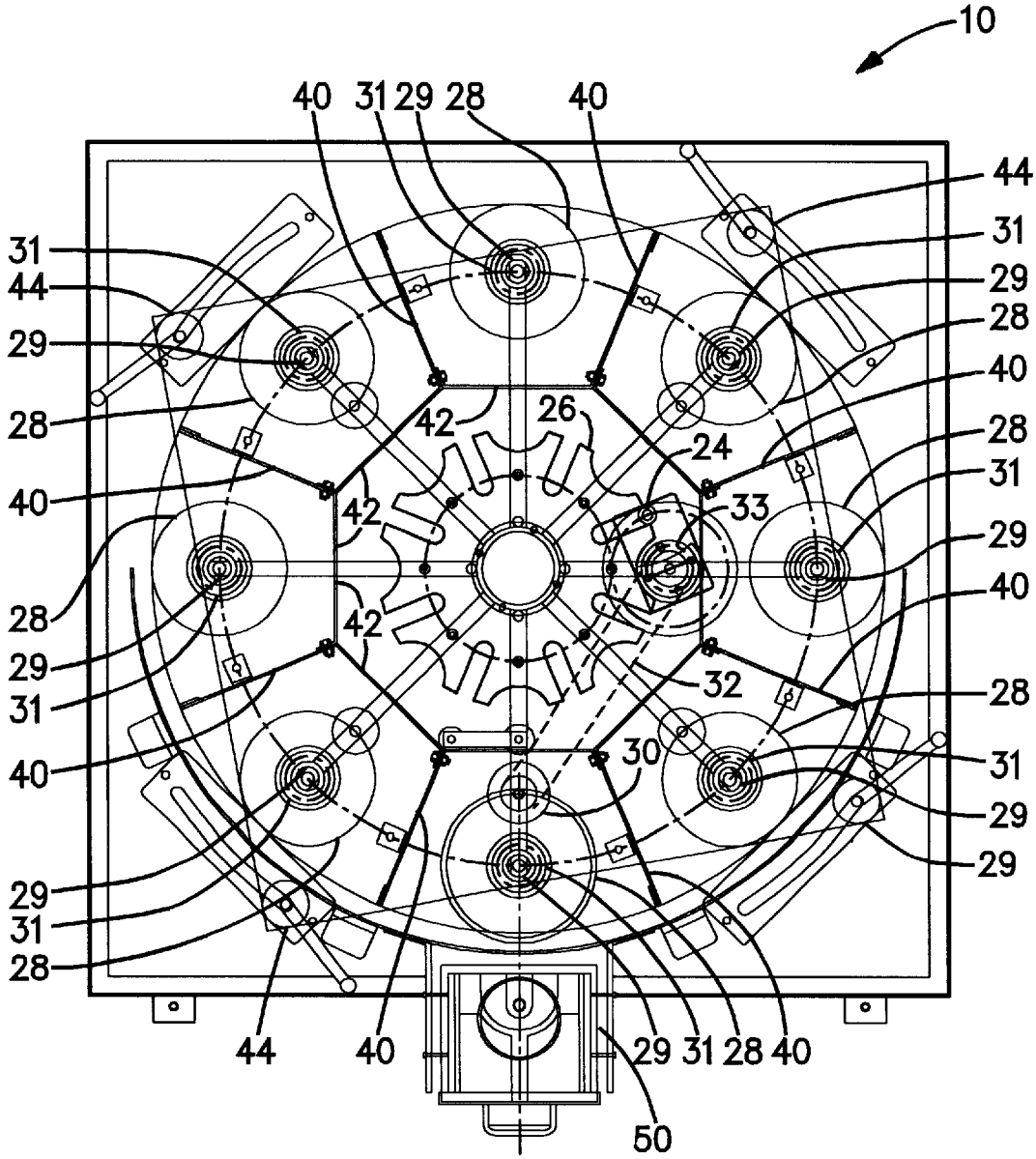
FIG. 3 is a partially sectional view taken along a horizontal plane illustrating the drive mechanism for the apparatus.
Figure 4:
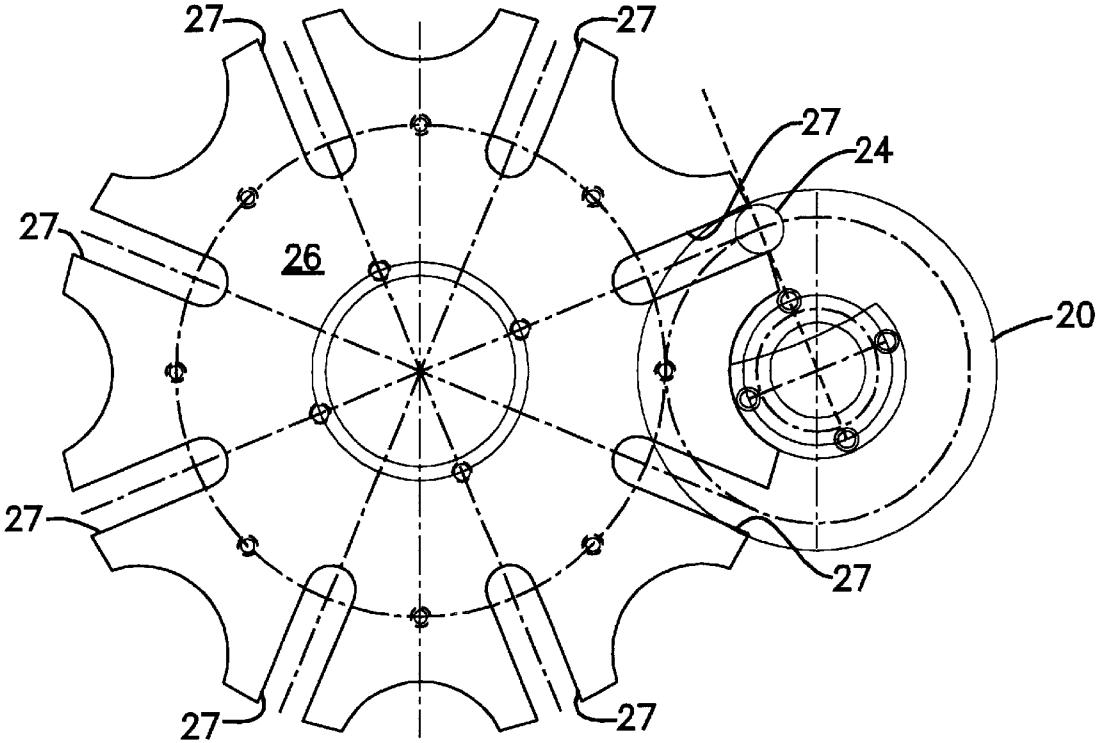
FIG. 4 is a more detailed plan view of the Geneva mechanism that is used in the drive mechanism to translate rotary motion from a motor to periodic angular motion.
Figure 5:
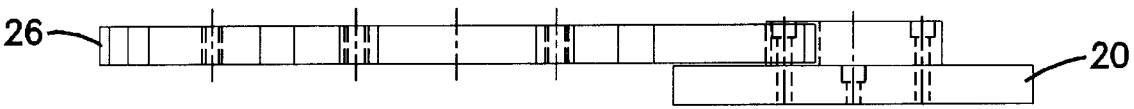
FIG. 5 is a side elevation view of the apparatus illustrated in FIG. 4.

Referring now to FIGS. 1–5, there is shown an ultraviolet light curing apparatus 10 in accordance with one form of the present invention. The ultraviolet light curing apparatus 10 includes an enclosure 12 and an ultraviolet light shield 14. Disposed within the enclosure 12 is a motor 16 that cooperates with a slip clutch 18 that causes rotation of a driver plate 20. The slip clutch 18 is provided for safety so that in the event a hand or arm of a user is inadvertently disposed in interfering relationship with the moving mechanism, the slip clutch 18 will allow slippage in the drive mechanism to prevent injury to that person or any other object that may be in interfering relationship. The driver plate 20 cooperates with an indexer 26. The driver plate 20 and the indexer 22 are collectively referred to as a Geneva mechanism. Geneva mechanisms are well known to translate rotary motion into intermittent angular motion. More specifically, as best seen in FIG. 3, the driver plate 20 includes a pin 24 disposed in up-standing relationship from the driver plate 20. The indexer 26 has eight radially extending slots extending at equal angular positions about a vertical axis. In the conventional manner, the pin 24 will enter a first one of the eight slots 27 in the indexer 26. This causes the indexer 26 to rotate to one of eight discreet angular positions corresponding to the eight discreet slots in the indexer 26. Continued rotary motion of the driver plate 20 causes the pin 24 to withdraw from the first one of the eight slots 27 in the indexer 26 and then enter an angularly adjacent radial slot 27 in the indexer 26. In this manner, the Geneva mechanism causes sequential dwells, in which the indexer plate does not move, followed by an angular movement. In the illustrated embodiment, the indexer has eight slots corresponding to the movement of one-eighth of 360 degrees.

Cooperating with the indexer 26 are eight workstations 28. The workstations 28 are disposed at equal angular intervals about the periphery of the apparatus. An ultraviolet radiation apparatus 3 is disposed at the periphery of the apparatus. The ultraviolet radiation apparatus 50 is of conventional design. It includes one or more ultraviolet lamps producing a focused vertical beam that has a width of less than about one inch. No shutters or the like for exposure control are required. By virtue of the stepping action produced by the driver plate 20 and the indexer 26, one of the workstations 28 is normally disposed adjacent to the ultraviolet radiation apparatus 50 during any given dwell of the indexer 26. In other words, in normal operation successive peripherally adjacent workstations 28 will move to a position adjacent to the ultraviolet radiation apparatus 50. Obviously, there will be eight discreet positions of the indexer 26 in a given rotation of the indexer and each of the workstations 28 will dwell adjacent to the ultraviolet radiation apparatus 50. This is the normal mode of operation. Another mode of operation is provided for use in curing paints and inks on relatively flat objects. This alternative mode will be described below.

Each workstation 28 comprises a spindle-mounted platform. Each spindle 29 is vertical and mounted to allow rotation about the axis thereof. The lower extremity of each spindle has a cylindrical surface 31. Each workstation 28 is rotated during normal mode operation, during the dwell of the workstation 28 next to the ultraviolet radiation apparatus 50. The apparatus for causing this rotation includes a sprocket 33 mounted on the output shaft of the slip clutch 18. A chain 32 drives a sprocket 37 mounted on the same rotatably mounted shield as a rubber roller 30. The rubber roller 30 is mounted to rotate with the indexer 26. As the indexer 26 makes its periodic angular movement, the rubber roller 30 engages the cylindrical surface 31 of the spindle mounted workstation 28 that is near the ultraviolet radiation apparatus 50. Accordingly, as each workstation 28 moves near to the ultraviolet radiation apparatus 50, the rubber roller 30 causes rotation of the spindle mounted workstation 28. Thus, the work piece disposed at the workstation near to the radiation device 50 receives radiation about the entire circumference thereof. In the preferred embodiment the angular rotation of the work piece is approximately 270 degrees. The choice of 270 degrees as opposed to 360 degrees is preferred because the radiation is not focused along an infinitesimal thin vertical line. More particularly, it is focused over an arcuate portion of the circumference of the work piece. If the travel of the work piece were a full 360 degrees, the initial and final positions would be identical and the exposure to the radiation would be excessive at that one angular position.

The apparatus includes a coupling 34 for connection to an associated vacuum pump (not shown) and eight radially extending pipes 36. The radially extending pipes 36 each extend to one of the eight workstations 28. The vacuum is ported to the face of each workstation 28 to more securely hold a work piece as it travels from a loading station, (typically located opposite the radiation device) to the radiation device and than to an unloading station. It will be understood that the vacuum application to the work piece ensures that the work piece does not fall off the workstation despite the angular rotation of the work piece, when the work piece reaches the ultraviolet apparatus 50. This permits the curing of coatings on tall, narrow or irregularly shaped objects. The rotating apparatus includes light shields 40, 42 that are disposed about each workstation 28 to protect the operator of the apparatus.

In the alternative mode of operation, used primarily for relatively flat objects, it is desirable that the work piece not dwell in front of the ultraviolet radiation apparatus. More specifically, it is desired that the work piece move continuously while this work piece is being exposed to the light from the ultraviolet radiation apparatus 50. In the present apparatus this is achieved by indexing or changing the relative angular positions of (1) the ultraviolet light shield 14 with the attached ultraviolet radiation apparatus 50 with respect to (2) the enclosure 12 with the mechanisms shown in FIG. 3. In other words the light shields 14, 40, 42 with the attached ultraviolet radiation apparatus 50 attached thereto are moved from (1) a position such as that shown in FIG. 3 where the ultraviolet radiation apparatus 50 is aligned precisely with the spindle of the workstation 28 during the dwell of the Geneva mechanism comprising the indexer 26 and the driver plate 20 to (2) a position where the ultraviolet radiation source 50 is disposed midway between adjacent workstations 28 at the time of the dwell of the indexer 26. As best seen in FIGS. 1, 2 and 3, this relative angular position is maintained by latches 44. Raising the respective handles of the latches 44 allows movement of the ultraviolet light shield 14 with the attached ultraviolet radiation apparatus 50 so that the dwell produced by the Geneva mechanism occurs when two circumferentially adjacent work pieces are equidistant from the ultraviolet radiation apparatus 50. Accordingly, in this alternative mode of operation the work piece dwells or remains stationary only when the work piece is spaced well away from the ultraviolet radiation apparatus 50.

It will thus be seen that the apparatus in accordance with present invention utilizes a structure that is relatively simple and which enables achieving a satisfactory cure on work pieces having a wide variety of shapes. Various modifications and additions to the structure described above will become readily apparent to those skilled in the art without departing from the spirit and scope of the invention.

What is claimed:

1. Apparatus for curing ink, paint and coatings on containers and articles, comprising:

a rotatably mounted assembly that includes a plurality of workstations disposed about the periphery thereof;

an ultraviolet radiation emitter disposed next to the periphery of said rotatably mounted assembly;

means including a mechanical mechanism, for sequentially positioning respective workstations directly in front of said emitter, including means for causing at least some of said workstations to dwell in front of said emitter;

means for selectively rotating at least some of said workstations when a respective workstation is disposed in front of said emitter; and means for holding an associated work piece on at least some of said workstations, including means for applying a vacuum to a support structure on at least some of said workstations.

2. The apparatus according to claim 1, further including means for changing the position relative to the emitter at which any dwell of each workstation occurs during the rotational cycle of said rotatably mounted assembly.

3. The apparatus according to claim 2, wherein said means for changing includes means for causing said dwell to occur while at least two workstations are equally distant from said emitter.

4. Apparatus for curing ink, paint and coatings on containers and articles, comprising:

a rotatably mounted assembly that includes a plurality of workstations disposed about the periphery thereof;

a stationary ultraviolet radiation emitter disposed next to the periphery of said rotatably mounted assembly;

means for rotating said assembly to sequentially position respective workstations directly in front of said emitter and causing at least some of said workstations to dwell in front of said emitter; and means for changing the position relative to the emitter at which any dwell of any workstation occurs during the rotational cycle of said rotatably mounted assembly.

5. The apparatus according to the claim 4, further including means for selectively rotating at least some of said workstations when a respective workstation is disposed in front of said emitter.

6. The apparatus according to claim 5, further including means for holding an associated work piece on at least some of said workstations.

7. The apparatus according to claim 6, wherein said means for holding includes means for applying a vacuum to a support structure on at least some of said workstations.

8. The apparatus according to claim 4, wherein said means for changing includes means for causing said dwell to occur while at least two workstations are equally distant from said emitter.

* * * * *